US005785107A

United States Patent [19]

Nagarwalla et al.

[11] Patent Number: 5,785,107

[45] Date of Patent: Jul. 28, 1998

[54] APPARATUS AND METHOD FOR PRODUCING MULTIPLE CORES

[75] Inventors: Pheroze J. Nagarwalla, St. Charles, Ill.; Scott Hendrie, Coldwater, Mich.; Raymond F. Witte, Naperville, Ill.

[73] Assignee: Georg Fischer Disa, Inc., Oswego, Ill.

[21] Appl. No.: 581,071

[22] Filed: Dec. 29, 1995

[51] Int. Cl.[6] ..... B22C 7/06; B22C 9/12; B22C 13/12

[52] U.S. Cl. ..... 164/16; 164/21; 164/201; 164/228

[58] Field of Search ..... 164/16, 18, 20, 164/21, 22, 28, 186, 200, 201, 202, 228

[56] References Cited

U.S. PATENT DOCUMENTS

| | | | |
|---|---|---|---|
| 2,899,724 | 8/1959 | Peterson . | |
| 2,911,691 | 11/1959 | Peterson . | |
| 3,556,195 | 1/1971 | Lund | 164/16 |
| 4,158,381 | 6/1979 | Michelson | 164/226 |
| 4,560,281 | 12/1985 | Harris et al. | 366/15 |
| 4,598,759 | 7/1986 | Allread et al. | 164/155.5 |
| 4,714,100 | 12/1987 | Bellis et al. | 164/16 X |
| 4,718,474 | 1/1988 | Bellis et al. | 164/16 X |
| 4,809,763 | 3/1989 | Schilling | 164/28 |
| 4,830,082 | 5/1989 | Bellis et al. | 164/16 |
| 4,899,802 | 2/1990 | Erana | 164/158 |
| 4,942,916 | 7/1990 | Hale et al. | 164/186 |
| 5,038,845 | 8/1991 | Kluge | 164/22 |
| 5,148,851 | 9/1992 | Murata | 164/20 |
| 5,355,929 | 10/1994 | Sorensen | 164/20 |
| 5,520,240 | 5/1996 | Peterle | 164/201 X |

FOREIGN PATENT DOCUMENTS

| | | | |
|---|---|---|---|
| 0238 771 | 9/1987 | European Pat. Off. . | |
| 0 278 716 | 8/1988 | European Pat. Off. . | |
| 0 635 322 | 1/1995 | European Pat. Off. . | |
| 0 640 418 | 3/1995 | European Pat. Off. . | |
| 346370 | 12/1921 | Germany . | |
| 396813 | 6/1924 | Germany . | |
| 646304 | 6/1937 | Germany | 164/201 |
| 285837 | 11/1970 | Germany . | |
| 29 37 414 | 1/1981 | Germany . | |
| 4006031 | 8/1991 | Germany | 164/228 |
| 41 31 181 | 10/1992 | Germany . | |
| 42 13 845 | 11/1993 | Germany . | |
| 43 27 041 | 6/1994 | Germany . | |
| 620 382 | 11/1980 | Switzerland . | |
| 310728 | 10/1971 | U.S.S.R. . | |
| 1678503 | 9/1991 | U.S.S.R. . | |

*Primary Examiner*—J. Reed Batten, Jr.
*Attorney, Agent, or Firm*—Marshall, O'Toole, Gerstein, Murray & Borun

[57] ABSTRACT

A core box assembly for molding cores includes a first core box and a second core box disposed above the first core box. Each of the core boxes has a cavity. A passage for delivering core material to the cavities in the core boxes extends through the second core box and into the first core box. The second core box is placed above the first core box and core material is injected into the core boxes.

15 Claims, 12 Drawing Sheets

APPARATUS AND METHOD FOR PRODUCING MULTIPLE CORES

TECHNICAL FIELD

The present invention relates generally to core making machines, and more particularly to an apparatus and method for producing multiple cores.

BACKGROUND ART

Core making machines are employed to produce sand cores that are in turn used to produce voids or recesses in cast parts. Such molding machines typically inject core sand (i.e., sand mixed with resin) into a core box having mating core box halves. In a horizontal parting line core box, an upper mating half or cope is disposed atop a lower mating half or drag. In a vertical parting line core box, one mating half is disposed to one side of the other mating half. Cavities for molding cores are defined, in both types of core boxes, between the mating halves.

In conventional sand core production processes, cores are produced in a core box having a single horizontal or vertical parting line. In a further known sand core production process, cores are produced in an apparatus having multiple vertical parting lines. That is, the apparatus includes at least three core box portions wherein cores are produced in cavities coincident with the vertical parting lines. Such a production technique results in a desirable increase in the number of cores that can be produced per machine cycle, thereby allowing greater productivity. A core making machine capable of manufacturing cores in such an apparatus includes a plurality of injection devices (otherwise referred to as injection heads), each of which injects core sand in a downward direction into an associated core box cavity.

While the above-described technique for increasing core production is found to be effective, its applicability to core production processes is limited. In particular, as noted above, the technique is only available for use in connection with core boxes having vertical parting lines. This is because the core sand must be injected downwardly owing to the design of the injection head. Such a filling direction cannot accommodate production of cores in a core box having more than one horizontal parting line. Thus, the technique is usable only to produce those cores that can be formed inside a box having vertical parting lines.

Some core shapes, however, are more suited for production in horizontal parting line core boxes than in vertical parting line core boxes. For example, horizontal parting line core boxes are more suitable when large cores or a large number of cores are to be produced in one core box so that the cavities for forming the cores extend relatively far from the core sand injection apparatus. Horizontal parting line core boxes are also more suitable when the invest area cannot be on the casting surface of the core.

The size of the horizontal parting line core box may be increased to increase the number of cores that can be produced during one machine cycle. The area of the top of the horizontal parting line core box, however, determines the amount of pressure required to keep the core box from parting during injection of core sand. Larger areas require higher pressure. Core making machines capable of subjecting core boxes to high pressure are generally more expensive and larger than core making machines capable of subjecting core boxes to only low pressure. Thus, increasing the size of the horizontal parting line core box has the undesirable effect of increasing the size, and thus the cost of the core making machine required to accommodate the larger core box.

SUMMARY OF THE INVENTION

The above-described problems with the prior art machines are overcome by a horizontal parting line core box assembly and a core making method in accordance with the present invention.

More particularly, an apparatus for producing cores includes a first or lower core box and a second or upper core box disposed above the lower core box. The lower core box may include a first or lower drag and a first or lower cope disposed above the lower drag. Similarly, the upper core box may include a second or upper drag and a second or upper cope disposed above the upper drag.

Preferably, means are included for lifting each cope above the corresponding drag as well as means for ejecting cores produced in the upper and lower core boxes. The ejecting means may include an upper ejector plate disposed between the upper drag and the lower cope and a lower ejector plate disposed below the lower drag. The ejecting means may also include an ejector pin.

Also preferably, a passage extends through the upper core box and into the lower core box for receiving core material. The passage is in fluid communication with first and second core cavities located in the lower and upper core boxes, respectively.

In accordance with a further aspect of the present invention, a lower core box includes a lower core cavity and an upper core box is disposed above the lower core box and has an upper core cavity therein. Delivery apparatus is provided including a core material delivery passage extending through the second core box into the first core box and delivery ports in fluid communication with the lower and upper core cavities.

A further aspect of the present invention comprises a method for producing cores utilizing a core making machine and first and second core boxes. The method includes the steps of placing the second core box above the first core box, lowering the injection head into a passage extending through the second core box into the first core box, injecting sand through the passage into cavities in the first and second core boxes to form cores, and ejecting the cores from the first and second core boxes.

The foregoing and other advantages of the invention will appear more fully hereinafter from a consideration of the detailed description which follows taken together with the accompanying drawings. It is to be expressly understood, however, that the drawings are for illustration purposes only and are not to be construed as defining the limits of the invention, reference being had to the appended claims for that purpose.

DESCRIPTION OF THE PREFERRED EMBODIMENTS

Figure 1:
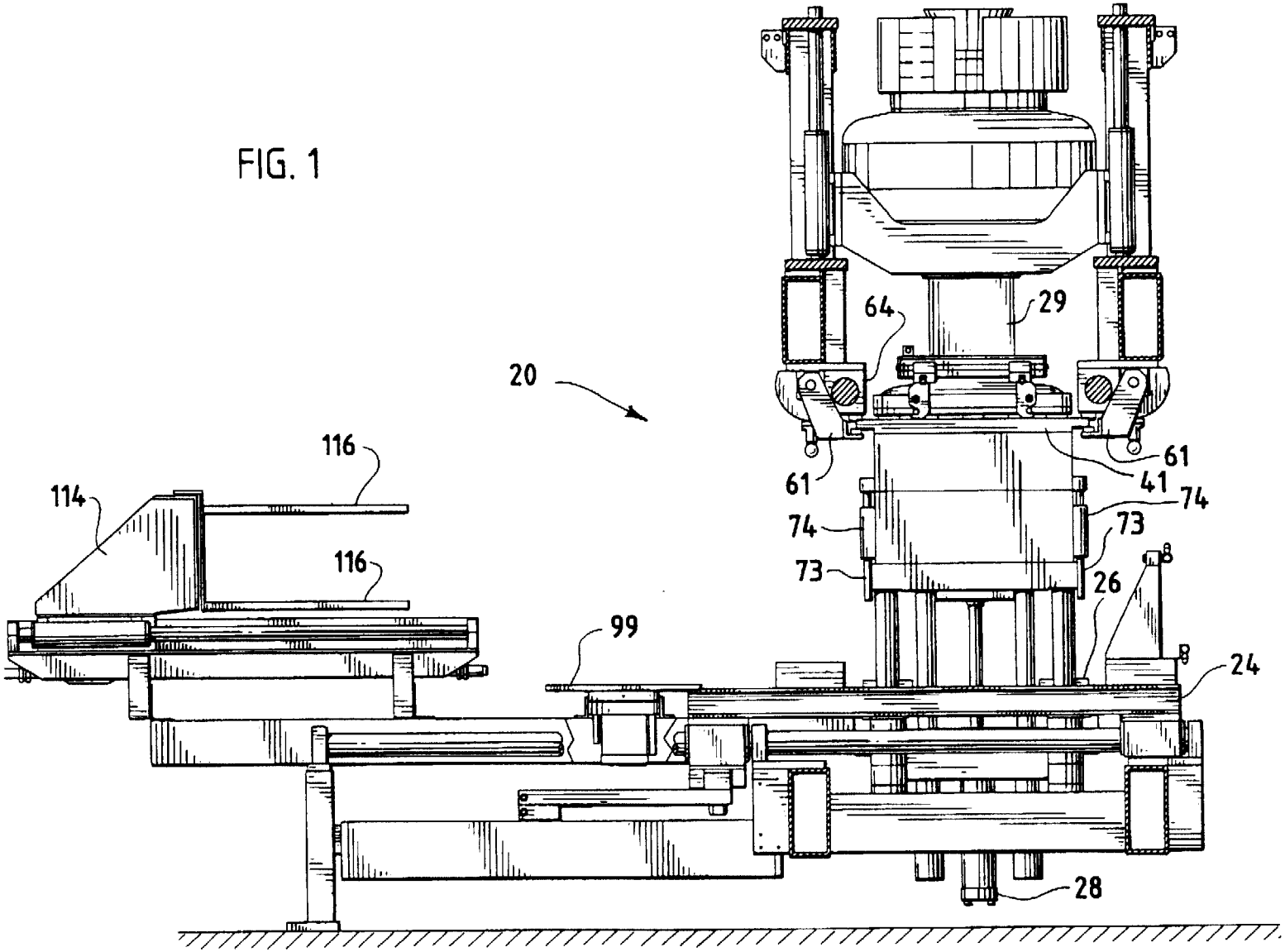
FIGS. 1 and 2 are elevational views, with portions broken away, illustrating a core making machine adapted to accommodate a multiple core box assembly according to the present invention during various stages of operation thereof.

Referring now to FIGS. 1–4, a core making machine 20 useful in the production of sand cores 22 (seen in FIGS. 2–4) and adapted to accommodate a multiple core box assembly 23 includes a shuttle system 24 having a frame 26 and disposed below the core box assembly 23. A ram 28 for lifting the core box assembly 23 is also disposed below the core box assembly 23. Disposed above the core box assembly 23 is an injection head 29 for injecting sand 30 into the core box assembly 23.

Figure 5:
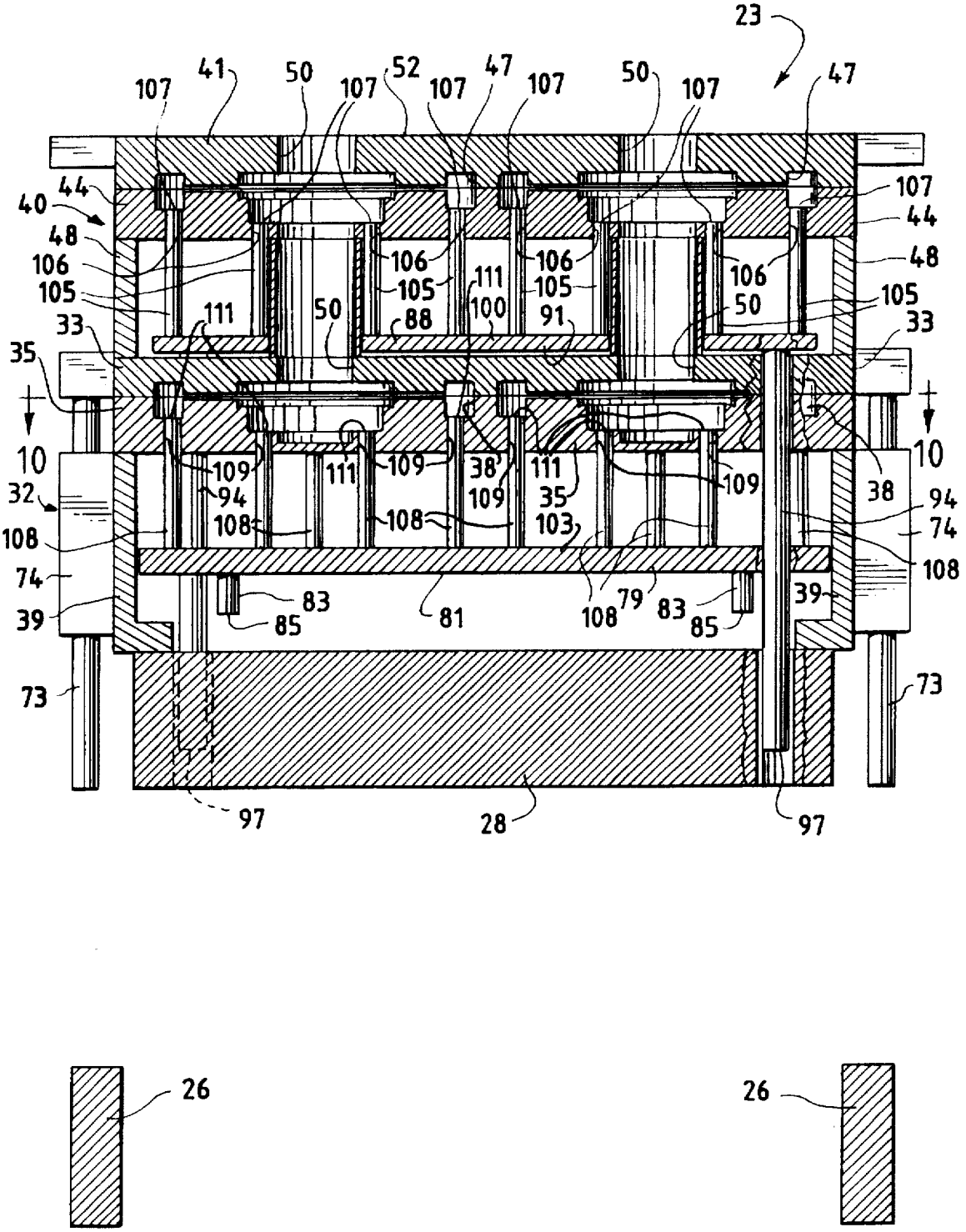
FIGS. 5–9 comprise full sectional views, with portions broken away, of the core box assembly of FIG. 4 during various stages of core production.

FIG. 5 shows the core box assembly 23 in a closed position. The core box assembly 23 has a first or lower core box 32 having a lower cope 33, a mating lower drag 35 disposed below the lower cope 33, lower core cavities 38 defined therebetween and a lower stool 39 disposed below the lower drag 35 for supporting the lower drag 35 and the remaining elements of the lower core box 32.

Located above the lower core box 32 is a second or upper core box 40 having an upper cope 41, a mating upper drag 44 disposed below the upper cope 41, and upper core cavities 47 defined between the upper cope 41 and the upper drag 44. The upper core box 40 further includes an upper stool 48 disposed between the upper drag 44 and the lower cope 33 for supporting the upper drag 44 and the remaining elements of the upper core box 40.

Figure 6:
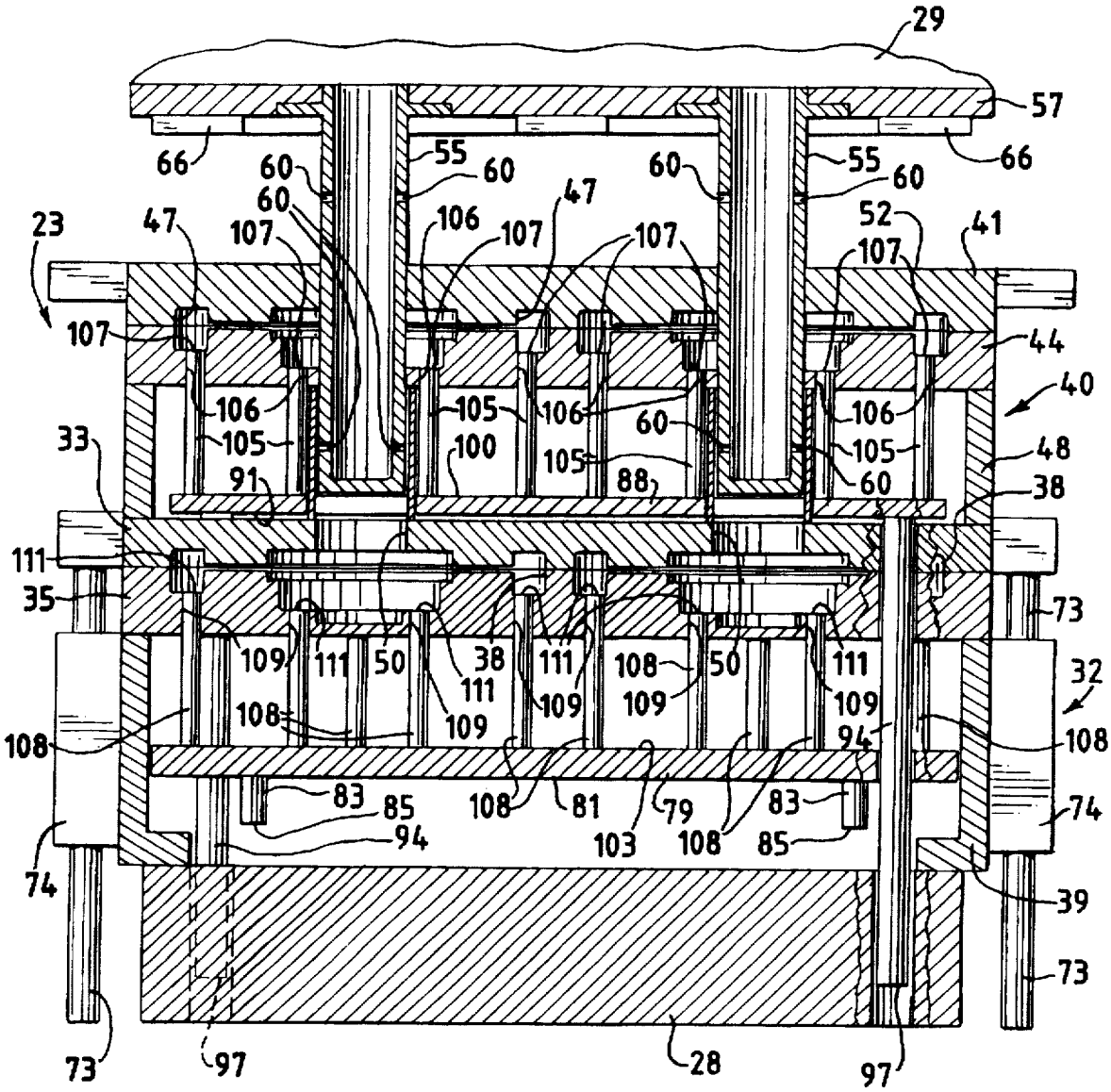

The core box assembly 23 further includes passages 50 extending from a top surface 52 of the upper cope 41 into the lower drag 35 for receiving injection tubes 55. As shown in FIG. 6, the injection tubes 55 are attached to an injection plate 57 and have delivery ports 60 for passing core material into the cavities 38, 47.

Figure 2:
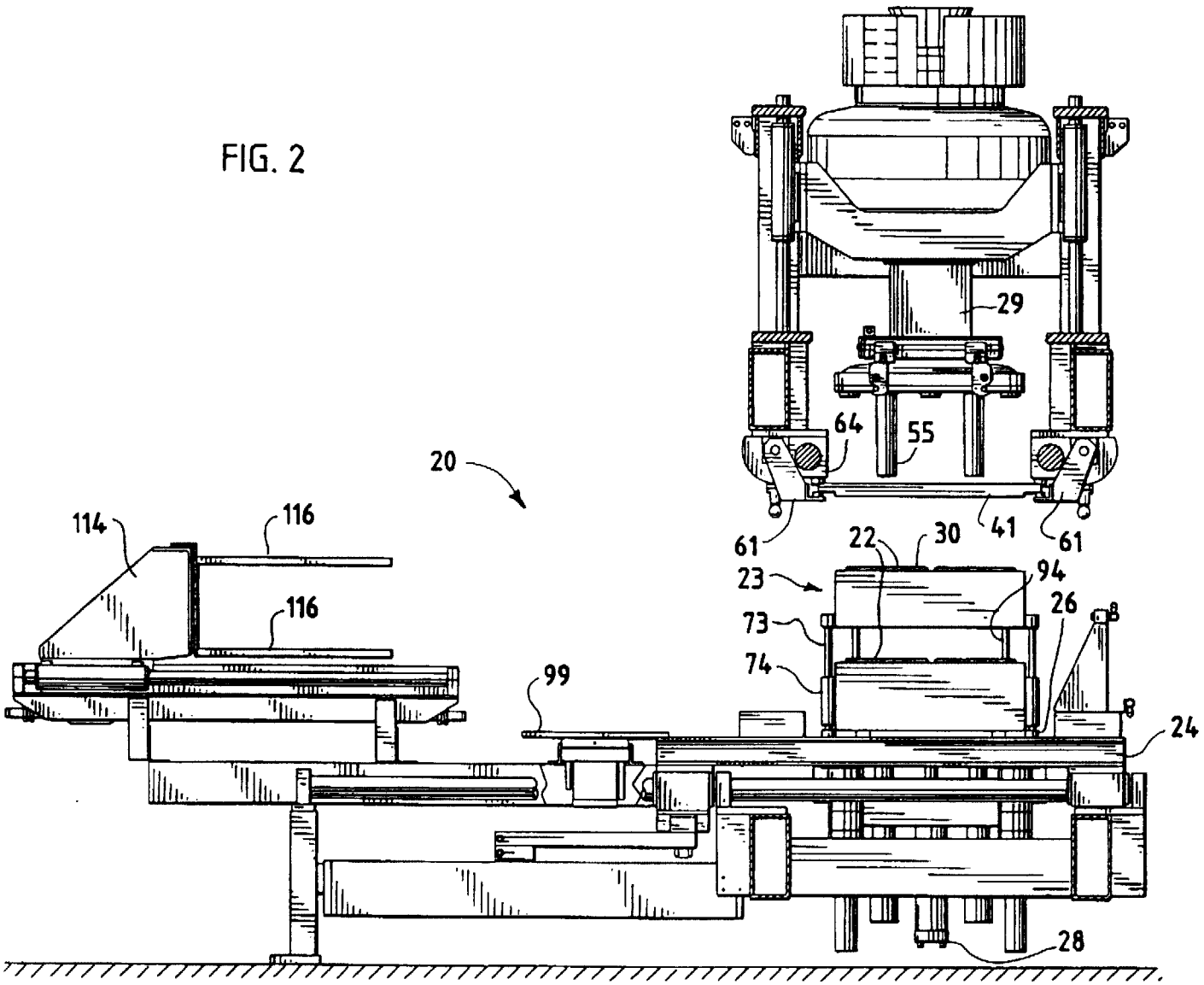
Figure 3:
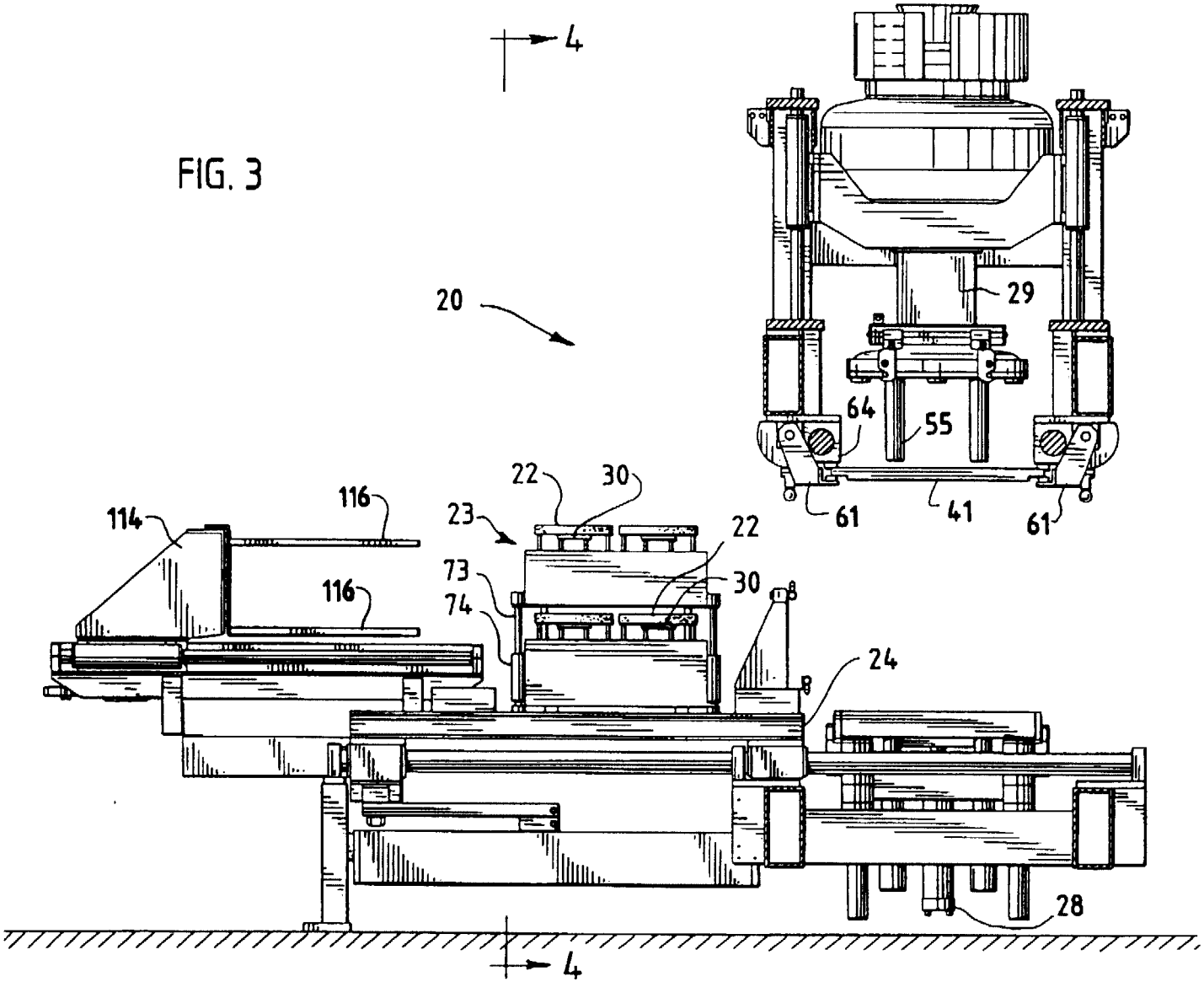
FIG. 3 comprises an elevational view illustrating the core making machine of FIGS. 1 and 2 following ejection of the cores.
Figure 4:
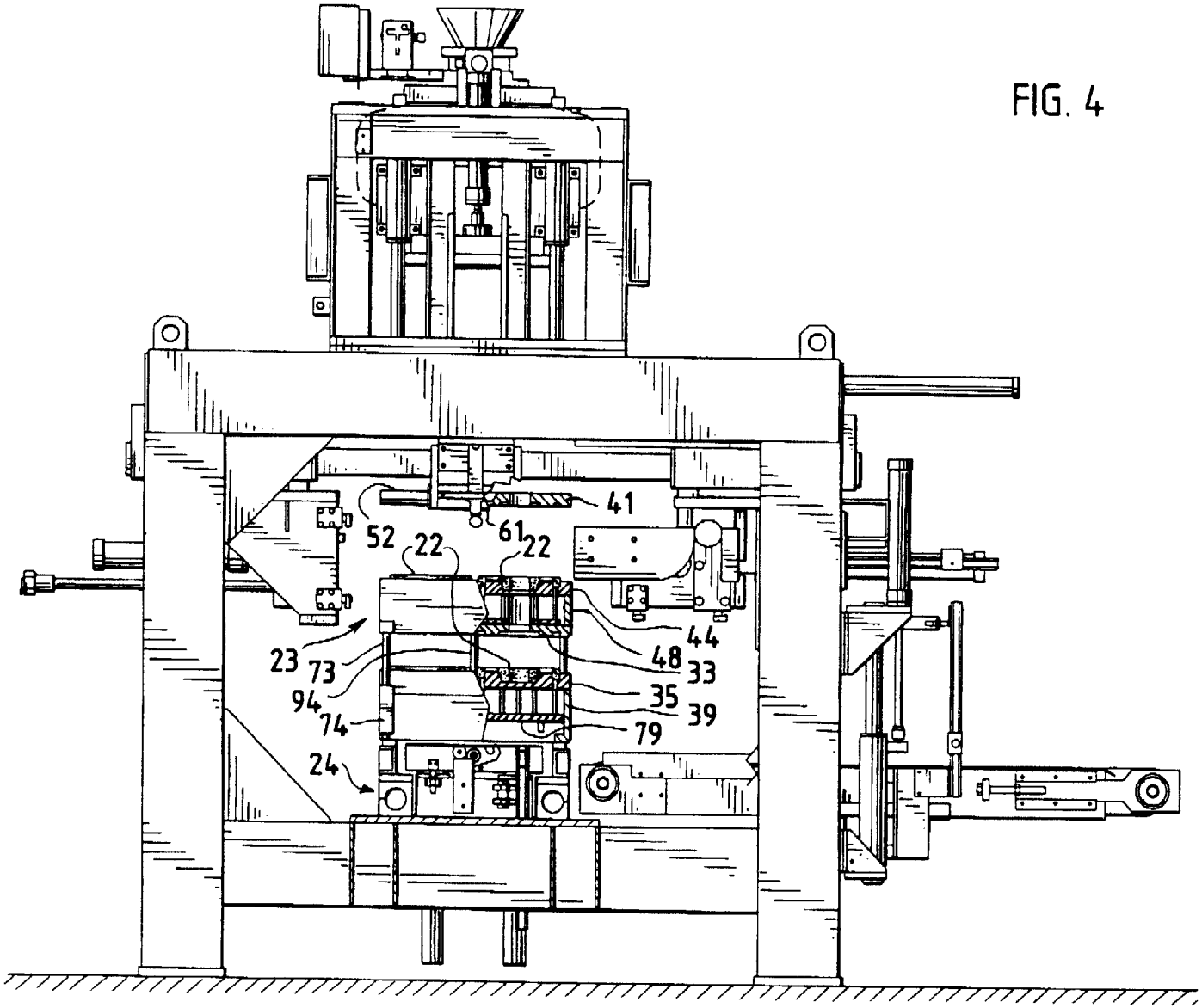
FIG. 4 comprises a sectional view taken generally along the lines 4—4 of FIG. 3 illustrating the core box assembly of the present invention with portions broken away.

A core making cycle begins by clamping the upper cope 41 with a clamp 61 (FIGS. 1–3). A frame 64 is disposed above the cope 41 for preventing upward movement of the upper cope 41. After the upper cope 41 has been clamped, the ram 28 is raised until the core box assembly 23 is closed (seen in FIG. 1), at which point the upper cope 41 is in contact with the upper drag 44 and the lower cope 33 is in contact with the lower drag 35 (as seen in FIG. 5).

Once the core box assembly 23 is closed, the injection head 29 is lowered, causing the injection tubes 55 to enter the passages 50 in the core box assembly 23 as shown in FIG. 6. The injection tubes 55 stop lowering when spacer blocks 66 attached to the injection plate 57 contact the top surface 52 of the upper cope 41. At that point, the delivery ports 60 in the injection tubes 55 are in fluid communication with and adjacent the lower core cavities 38 and upper core cavities 47.

Figure 7:
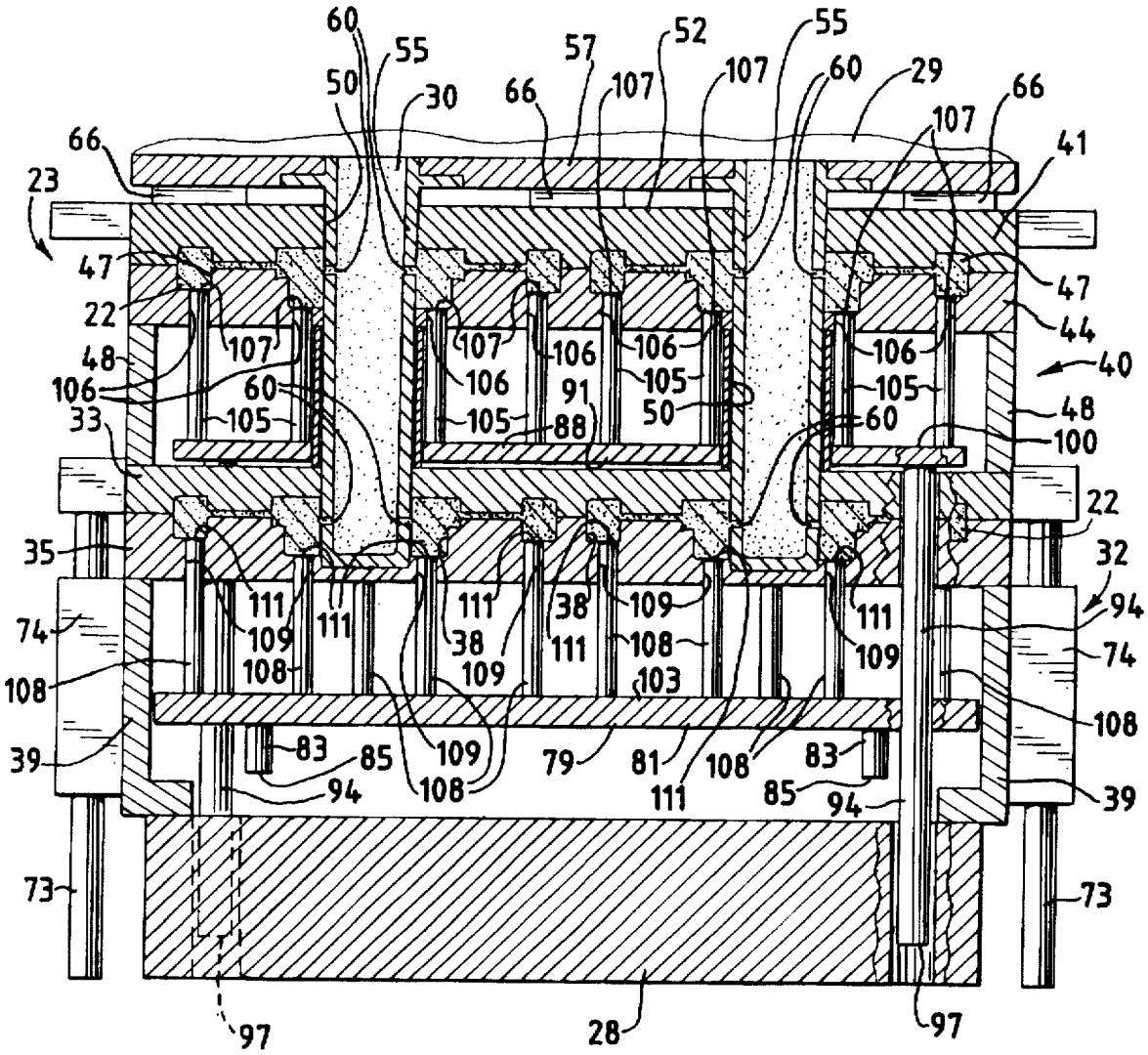

During injection, the sand 30 is forced into the injection tubes 55 under pressure by the injection head 29, which may be an extruding head, a blowhead or any other conventional structure for forcing sand into core boxes. The sand 30 exits the injection tubes 55 laterally at the delivery ports 60 and flows into the cavities 38, 47. FIG. 7 shows the injection tubes 55 in the core box assembly 23 following injection of the sand 30 into the lower and upper cavities 38, 47.

It is preferred that the core box assembly 23 be capable of making cores 22 of different shapes. It will be appreciated that the number, size, shape and arrangement of the delivery ports 60 may be varied in order to optimally pass core material into different configurations of the cavities 38, 47.

Figure 8:
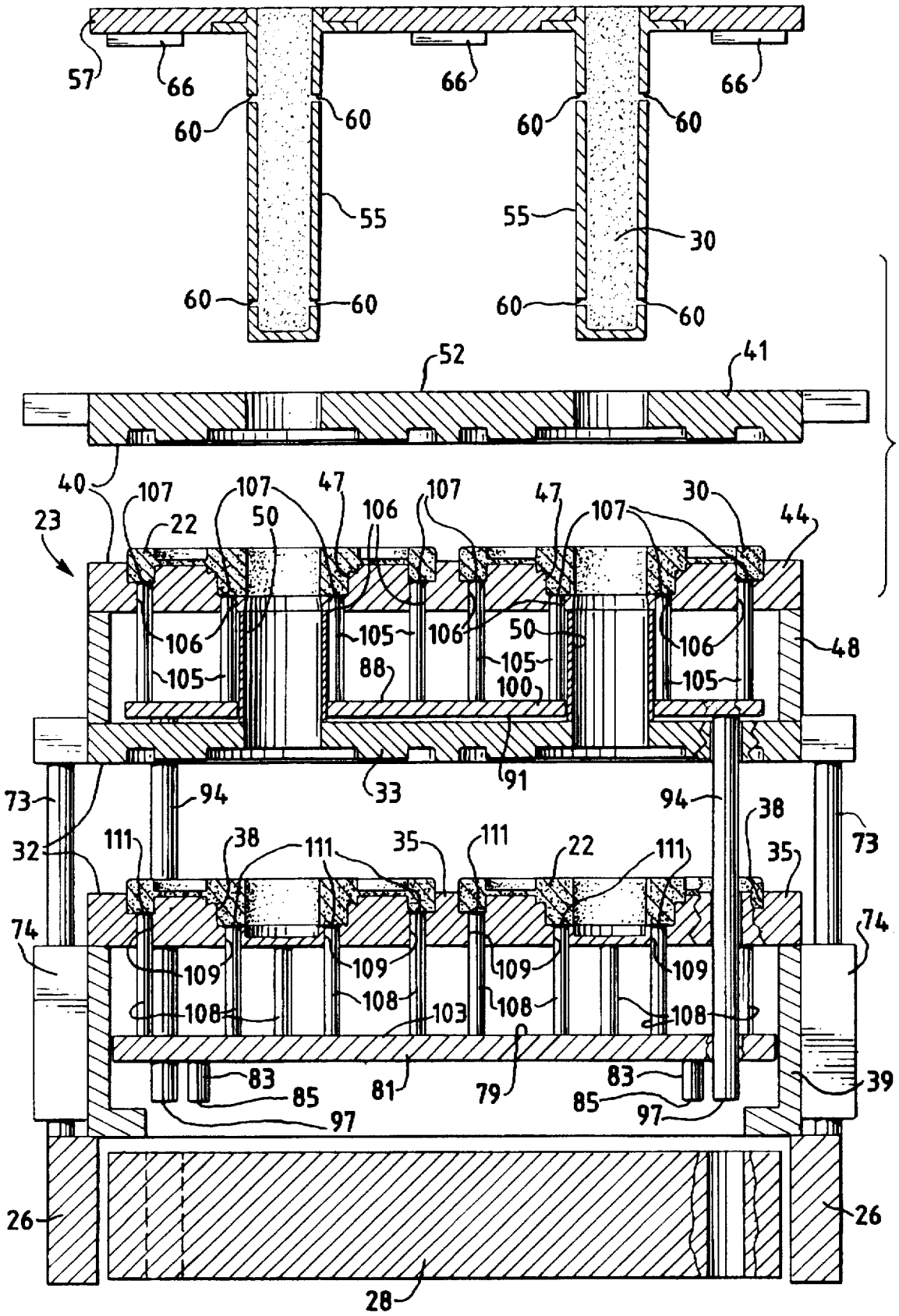

Following injection, the injection head 29 is raised, raising the injection tubes 55 above the core box assembly 23 (the raised tubes 55 are shown in FIG. 8 after opening of the core box portions). A gassing plate (not shown) is then placed into engagement with the core box assembly 23. Once engaged, the gassing plate gasses and thereby cures the cores 22.

Following curing, the ram 28 is lowered, lowering the core box assembly 23 (except for the upper cope 41) toward the shuttle system 24 in a unitary fashion. The upper cope 41 is still held by the clamp 61, and thus the upper drag 44 is lowered relative to the upper cope 41, thereby exposing the cores in the upper core cavities 47.

Also as the ram 28 is lowered, guide rods 73 fixed to the lower cope 33 and slidably engaged in bushing blocks 74 contact the frame 26 of the shuttle system 24. The frame 26, which is stationary, prevents further downward movement of the guide rods 73 which, in turn, prevent further downward movement of the lower cope 33. The lower core box 32 opens as the lower drag 35 continues to lower relative to the lower cope 33. Components of the core box assembly 23 which are located above the lower cope 33, such as the upper core box 40 (without the upper cope 41), are also prevented from further downward movement when the lower cope 33 is prevented from further downward movement by the frame 26.

FIG. 8 shows the core box assembly 23 in an open position supported by the frame 26 after the lower drag 35 has lowered relative to the remaining portions of the core box assembly 23. At this point, the upper cope 41 is clamped above the remaining core box portions by the clamps 61 (not shown in FIG. 8 but seen in FIGS. 1–3).

Disposed below the lower drag 35 in the lower core box 32 is a lower ejector plate 79. Attached to a bottom portion 81 of the lower ejector plate 79 are lower push rods 83 having bottom ends 85.

Disposed below the upper drag 44 in the upper core box 40 is an upper ejector plate 88. Attached to a bottom portion 91 of the upper ejector plate 88 are upper push rods 94 having bottom ends 97. If desired, only a single upper push rod 94 and a single lower push rod 83 may be provided and function similarly to the embodiment having multiple upper and lower push rods described below.

The upper push rods 94 are lifted while the lower cope 33 is being raised relative to the lower drag 35 (i.e., when the core box assembly 23 is being opened). When the raising of the lower cope 33 is complete, the bottom ends 85 of the lower push rods 83 are even with the bottom ends 97 of the upper push rods 94.

Once the core box assembly 23 has been opened, it is in the position shown in FIG. 2. The shuttle system 24 then shuttles the core box assembly 23 from under the injection head 29 into the ejector position (FIG. 3). Once in the ejector position, a machine ejector 99 (FIGS. 1, 2, and 9) for ejecting the cores 22 is located below the lower drag 35. The machine ejector 99, raised relative to the core box assembly 23 by a hydraulic ram or similar structure, contacts the bottom ends 97 of the upper push rods 94 and also contacts the bottom ends 85 of the lower push rods 83. As the rising machine ejector 99 raises the upper and lower push rods 94, 83, the upper and lower ejector plates 88, 79 are raised.

Attached to a top portion 100 of the upper ejector plate 88 are upper ejector pins 105 for ejecting the cores 22. The upper ejector pins 105 extend into holes 106 in the upper drag 44 and, when the core box assembly 23 is in a closed position, tops 107 of the upper ejector pins 105 are adjacent the bottoms of the upper cavities 47.

Figure 9:
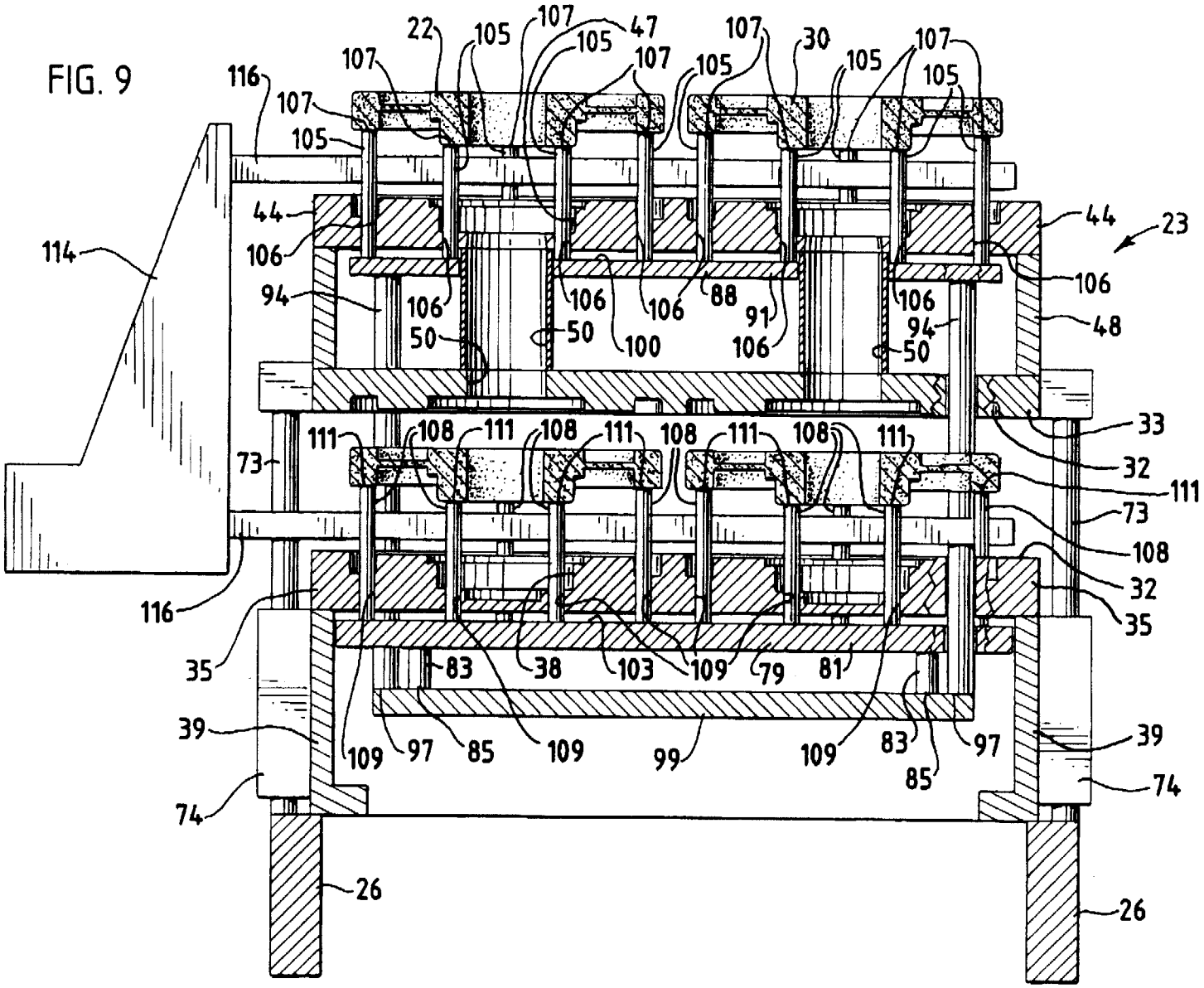
Figure 10:
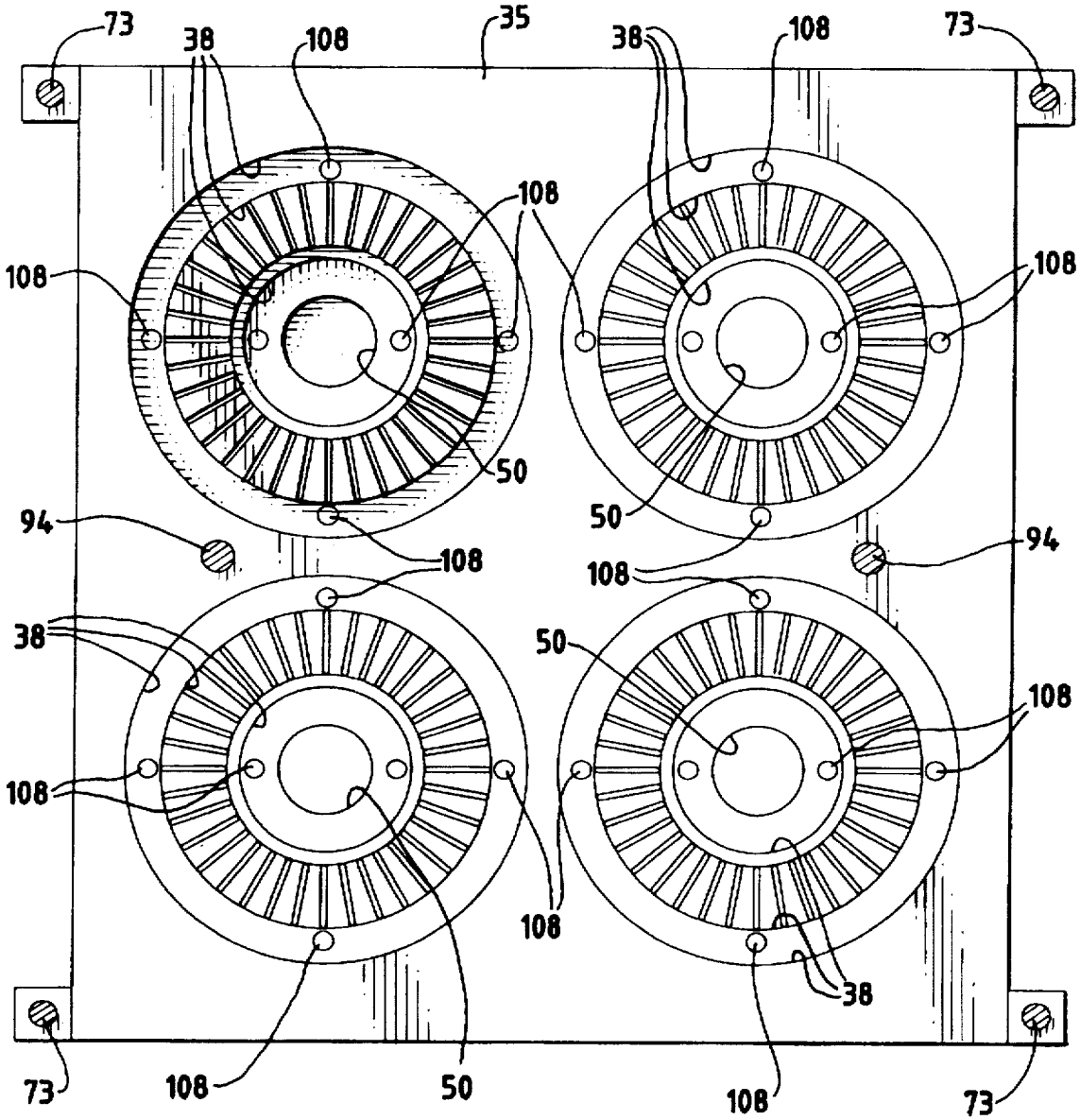
FIG. 10 comprises a sectional view taken generally along the lines 10—10 of FIG. 5.

Attached to a top portion 103 of the lower ejector plate 79 are lower ejector pins 108 for ejecting the cores 22. The lower ejector pins 108 extend into holes 109 in the lower drag 35 and, when the core box assembly 23 is in a closed position, tops 111 of the lower ejector pins 108 are adjacent the bottoms of the lower cavities 38. As shown in FIG. 9, the upper and lower ejector pins 105, 108 push the cores 22 up above the respective drags 35, 44. The relative positions of the lower ejector pins 108, the upper push rods 94, and the guide rods 73 in a horizontal plane are shown in FIG. 10.

After the ejector pins 105, 108 have raised the upper and lower cores 22 above their respective drags 35, 44, a finger pick-off assembly 114 (FIGS. 1–3) for removing the cores 22 moves toward the core box assembly 23. FIG. 9 shows the assembly 114 adjacent the core box assembly 23. In that position, fingers 116 extending from the assembly 114 support the cores 22 as the machine ejector 99 is lowered. As the core box assembly 23 lowers with the machine ejector 99, the cores 22 are left upon the fingers 116.

The shuttle system 24 then shuttles the core box assembly 23 back under the injection head 29 and the assembly 114 retracts, carrying the cores 22 to a location where the cores 22 may be further processed, stored, or transferred. The core making sequence begins again starting with the clamping of the upper cope 41 by the raising of the ram 28 to close the core box assembly 23.

Figure 11:
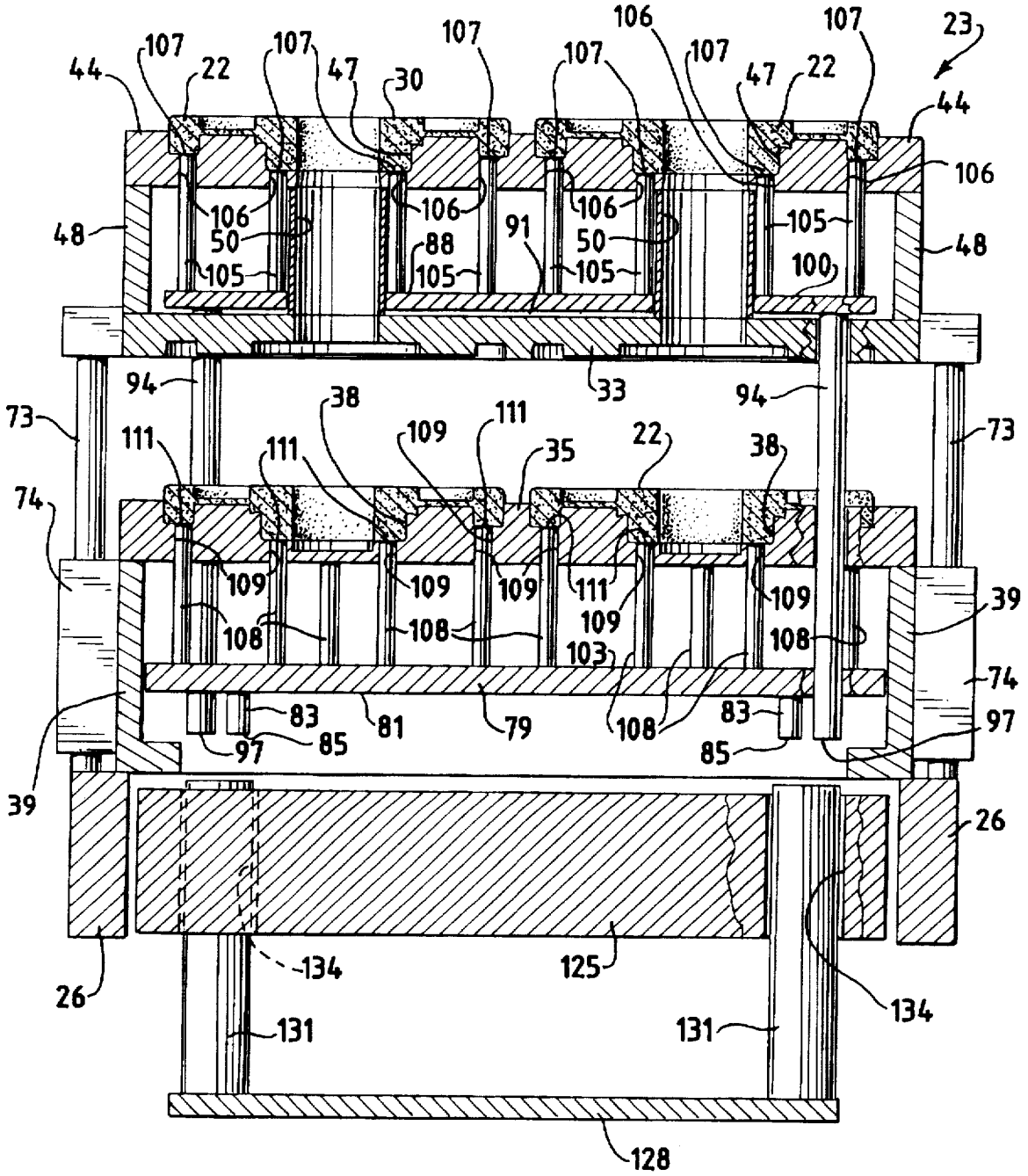
FIG. 11 comprises a sectional view, with portions broken away, of a core box assembly in accordance with the present invention above an alternative ejector mechanism.
Figure 12:
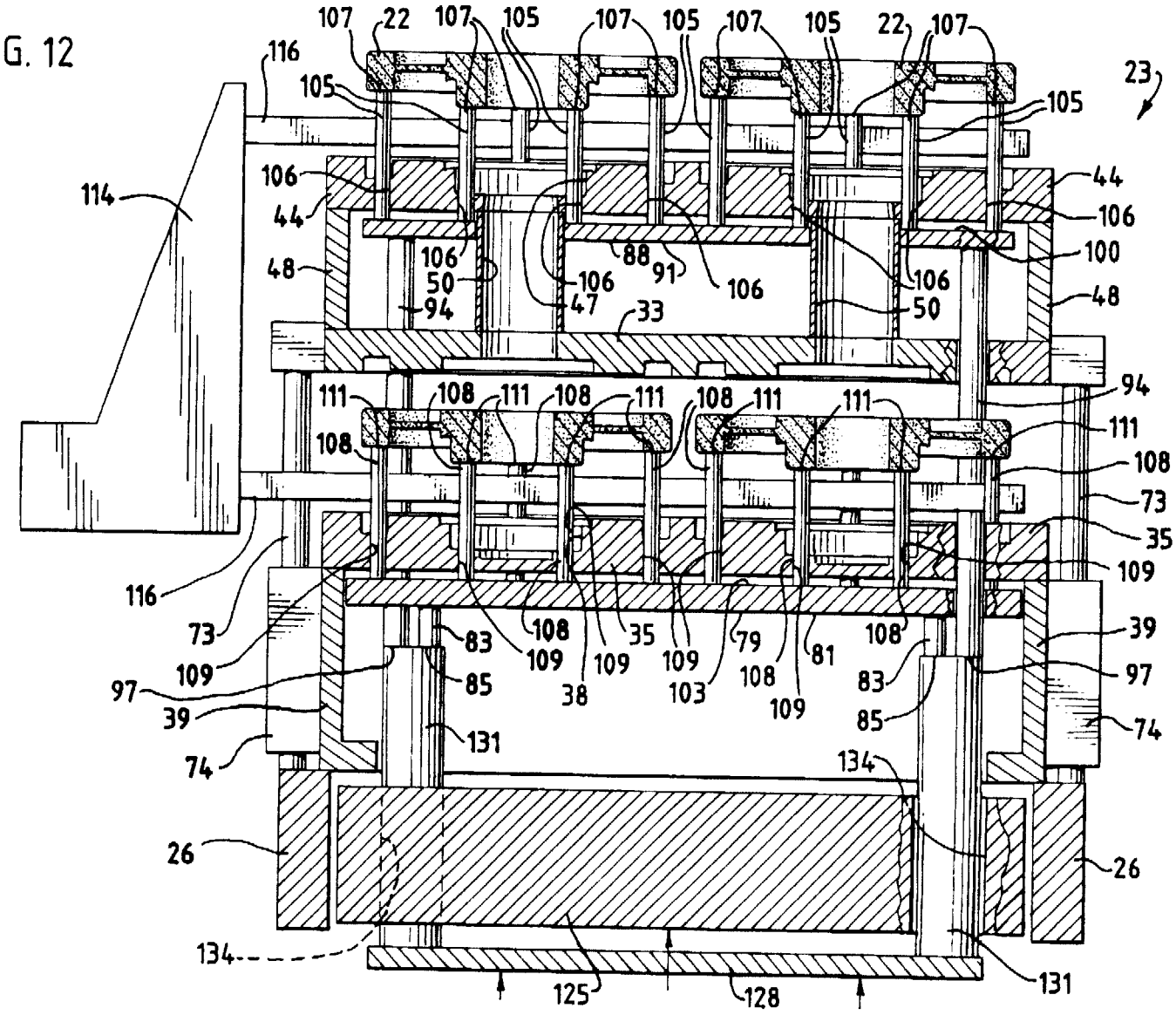
FIG. 12 comprises a view similar to FIG. 11 following ejection of cores from the core box assembly.

An alternative embodiment of the present invention, shown in FIGS. 11 and 12, includes structure for ejecting the cores 22 while the core box assembly 23 is located above a ram 125 similar to the ram 28. In such an embodiment, after the cores 22 have been formed and the frame 26 has opened the core box assembly 23 (i.e., once the lower cope 33 has been lifted upwardly relative to the lower drag 35), the core box assembly 23 is not shuttled to the machine ejector 99. Instead, an ejector plate 128 disposed below the ram 125 is raised by an actuator (not shown), forcing ejector rods 131 upwardly through passages 134 in the ram 125. The ejector rods 131 may be attached to the ejector plate 128 by any suitable means. Eventually, as seen in FIG. 12, the ejector rods 131 contact the bottom ends 85, 97 of the lower and upper push rods 83, 94, respectively. As the lower and upper push rods 83, 94 are lifted, the lower and upper ejector plates 79, 88 are lifted and the upper and lower ejector pins 105, 108 are lifted as well. As a result, the cores 22 are raised with respect to the lower and upper drags 35, 44.

In an alternative core ejection sequence, the ejector plate 128 and the attached ejector rods 131 are raised with respect to the ram 125 prior to the core box assembly 23 being opened. As the ram 125 is lowered, the core box assembly 23 opens by contacting the frame 26. The ram 125, and thus the core box assembly 23, continue to lower. Eventually, the bottom ends 85, 97 of the lower and upper push rods 83, 94, respectively, contact the already-raised ejector rods 131. The push rods 83, 94 are held stationary by the ejector rods 131 and, as the ram 125 continues to lower, the ram 125 lowers with respect to the push rods 83, 94. As a result, the lower and upper drags 35, 44 are lowered with respect to the cores 22.

The operation of the assembly 114 is similar in this embodiment to the operation of the assembly 114 in the embodiment discussed earlier. In this embodiment, however, the cores 22 are left supported by the fingers 116 of the assembly 114 when the ejector plate 128 is lowered rather than when the machine ejector 99 is lowered.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A core box assembly, comprising:

a lower core box having a lower core cavity;

an upper core box having an upper core cavity;

the upper core box being disposed above the lower core box; and a passage through the upper core box and into the lower core box for passing core material, the passage being in fluid communication with the upper and lower core cavities.

2. The core box assembly of claim 1 wherein:

the lower core box includes a lower cope and a lower drag disposed below the lower cope, the lower core cavity being defined between the lower cope and the lower drag; and the upper core box includes an upper cope and an upper drag disposed below the upper cope, the upper core cavity being defined between the upper cope and the upper drag.

3. The core box assembly of claim 2, in combination with means for lifting the upper cope above the upper drag, means for lifting the lower cope above the lower drag, and means for ejecting cores from the upper drag and the lower drag.

4. The core box assembly of claim 3, wherein the ejecting means includes an upper ejector plate disposed between the upper drag and the lower cope and a lower ejector plate disposed below the lower drag.

5. The core box assembly of claim 3, wherein the ejecting means comprises an ejector pin.

6. The core box assembly of claim 2, further including an upper ejector plate disposed between the upper drag and the lower cope and a lower ejector plate disposed below the lower core box.

7. An apparatus for producing cores, comprising:

a lower core box having a lower core cavity therein;

an upper core box disposed above the lower core box and having an upper core cavity therein; and delivery apparatus having a core material delivery passage extending through the upper core box into the lower core box and delivery ports in fluid communication with the lower and upper core cavities.

8. The apparatus of claim 7, wherein each of the lower and upper core boxes includes a cope disposed above a mating drag.

9. The apparatus of claim 8, further including an upper ejector mechanism extending into the upper drag.

10. The apparatus of claim 9, wherein the upper ejector mechanism includes an ejector plate disposed between the drag of the upper core box and the cope of the lower core box and an ejector pin disposed on the ejector plate.

11. The apparatus of claim 9, wherein the upper ejector mechanism includes a push rod extending below the lower core box.

12. A method for producing cores utilizing a core making machine accommodating first and second core boxes, the first core box including a first cope disposed adjacent a first drag and a cavity therebetween and the second core box including a second cope disposed adjacent a second drag and a cavity therebetween, the method comprising the steps of:

placing the second core box above the first core box;

providing a passage in the first and second core boxes to accept an injection head;

lowering the injection head into the passage;

injecting sand into the cavities in the first and second core boxes to form cores therein; and ejecting the cores from the first and second core boxes.

13. The method of claim 12, wherein the ejecting step includes the step of raising a first ejector member disposed in the first core box and a second ejector member disposed in the second core box.

14. The method of claim 12, wherein the ejecting step includes the step of raising the first cope relative to the first drag.

15. The method of claim 12, wherein the ejecting step includes the step of raising the second cope relative to the second drag.

* * * * *